United States Patent [19]

Plapper et al.

[11] 4,221,564

[45] Sep. 9, 1980

[54] WATER-INSOLUBLE ALKALI METAL ALUMINOSILICATES AND POLYCARBOXYLIC ACIDS IN THE TANNING PROCESS FOR THE PRODUCTION OF LEATHER

[75] Inventors: Juergen Plapper, Hilden; Klaus Schumann, Erkrath; Emanuel Arndt, Düsseldorf; Emil Ruscheinsky, Leverkusen, all of Fed. Rep. of Germany

[73] Assignee: Henkel Kommanditgesellschaft auf Aktien (Henkel KGaA, Dusseldorf-Holthausen, Fed. Rep. of Germany

[21] Appl. No.: 923,662

[22] Filed: Jul. 11, 1978

[30] Foreign Application Priority Data

May 20, 1978 [DE] Fed. Rep. of Germany ..... 2822072

[51] Int. Cl.[2] ..... C14C 1/00; C14C 1/08

[52] U.S. Cl. ..... 8/94.17; 8/94.19 R; 8/94.27; 8/94.29; 8/94.3

[58] Field of Search ..... 8/94.17, 94.3, 94.27, 8/94.29, 94.19 R; 423/329

[56] References Cited

U.S. PATENT DOCUMENTS

| | | | |
|---|---|---|---|
| 2,123,832 | 7/1938 | Jaeger et al. | 8/94.17 |
| 2,395,472 | 2/1946 | Fernald et al. | 8/94.19 |
| 2,580,417 | 1/1952 | Follett et al. | 8/94.26 |
| 2,639,967 | 5/1953 | Rudy | 8/94.17 |
| 3,010,780 | 11/1961 | Plapper et al. | 8/94.26 |
| 3,356,450 | 12/1967 | Heinze | 423/329 |
| 4,042,321 | 8/1977 | Bäcker et al. | 8/94.27 |
| 4,071,377 | 1/1978 | Schwuger et al. | 252/179 |
| 4,089,929 | 5/1978 | Christophliemk et al. | 423/329 |
| 4,101,271 | 7/1978 | Bockelman et al. | 8/94.27 |
| 4,126,413 | 11/1978 | Träubel et al. | 8/94.27 |
| 4,126,574 | 11/1978 | Reinwald et al. | 252/179 |

FOREIGN PATENT DOCUMENTS

| | | | |
|---|---|---|---|
| 2535283 | 4/1976 | Fed. Rep. of Germany | 423/329 |
| 2271290 | 12/1975 | France . | |

OTHER PUBLICATIONS

Chemical Abstracts, vol. 69, (1968), No. 20430t.

*Primary Examiner*—Ronald W. Griffin
*Attorney, Agent, or Firm*—Hammond & Littel, Weissenberger & Muserlian

[57] ABSTRACT

In the process of tanning for the production of leather comprising subjecting uncured hides to the action of an aqueous liquor containing (1) chemical tanning agents, and (2) auxiliary chemicals to tanning and recovering leather, the improvement consisting of essentially of employing water-insoluble aluminosilicate, containing bound water of the formula $$(Cat_{2/n}O)_x \cdot Al_2O_3 \cdot (SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylate acids having from 4 to 8 carbon atoms, benzene dicarboxylic acids, benzenetricarboxylic acids and hydrolyzable partial esters thereof with aliphatic alcohols having from 1 to 6 carbon atoms and 1 to 6 hydroxyl groups as partial replacement of said chemical tanning agents and said auxiliary chemicals to tanning.

25 Claims, No Drawings

WATER-INSOLUBLE ALKALI METAL ALUMINOSILICATES AND POLYCARBOXYLIC ACIDS IN THE TANNING PROCESS FOR THE PRODUCTION OF LEATHER

BACKGROUND OF THE INVENTION

One of the most timely problems with leather production is the partial or complete replacement to be found for auxiliary agents, which put a high load on industrial sewage waters. This is the case particularly with the defatting and pretanning of pickled hides and the tanning of pelts and leather. Thereby aside from tanning matter other auxiliary agents, such as solvent and defatting agents, tensides, electrolytes, phosphates, neutralizers, etc. are utilized.

OBJECTS OF THE INVENTION

An object of the present invention is the improvement in the process of tanning for the production of leather comprising subjecting uncured hides to the action of an aqueous liquor containing (1) chemical tanning agents, and (2) auxiliary chemicals to tanning and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids, having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said chemical tanning agents and said auxiliary chemicals to tanning.

Another object of the present invention is the improvement in the process of pickling and chrome tanning of dehaired hides comprising subjecting dehaired hides to the action of an aqueous liquor containing (1) pickling acids, (2) chrome tanning agents, and (3) auxiliary chemicals to pickling and tanning, rinsing and recovering chrome tanned hides, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said pickling acids, chrome tanning agents and auxiliary chemicals.

A yet further object of the present invention is the improvement in the process of pickling and tanning uncured hides comprising subjecting uncured hides to the action of an aqueous liquor containing pickling agents and basic chrome salt tanning agents, and tanning auxiliaries for a time sufficient to tan said hides, rinsing and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said pickling agents, basic chrome salt tanning agent and tanning auxiliaries.

These and other objects of the present invention will become more apparent as the description thereof proceeds.

DESCRIPTION OF THE INVENTION

The object of the invention is to reduce the application of chemicals for leather production and to reduce the load on sewage waters from leather production. For this purpose according to the invention specified aluminosilicates are used in combination with di and/or tricarboxylic acids and/or their water-soluble hydroxyzable partial esters, which permit a considerable reduction of the normally used auxiliary substances, particularly chrome tanning substances, and which lead to a substantial improvement of the waste water situation, due to their ecological harmlessness.

This object is achieved by the use of water-insoluble, perferably bound-water containing aluminosilicates of the general formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, for leather production.

More particularly, the present invention relates to the improvement in the process of tanning for the production of leather comprising subjecting uncured hides to the action of an aqueous liquor containing (1) chemical tanning agents, (2) auxiliary chemicals to tanning and recovering leather, the improvement consisting essentially of employing water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said chemical tanning agents and said auxiliary chemicals to tanning.

Within the scope of the above improvement applicants have found that even better results are obtained when a joint pickling followed by chrome tanning procedure is followed where said polycarboxylate is added to the pickle bath and said aluminosilicate is added to the following chrome tanning bath. Therefore the invention also relates to the improvement in the process of pickling and chrome tanning of dehaired hides comprising subjecting dehaired hides to the action of an aqueous liquor containing (1) pickling acids, (2) chrome tanning agents and (3) auxiliary chemicals to pickling and tanning, rinsing and recovering chrome tanned hides, the improvement consisting essentially of employing a water-insoluble aluminosilicates, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, in combination with a polycarboxylate selected from the group consisting of aliphatic dicarboxylic acids having from 2 to 8 carbon atoms, aliphatic tricarboxylic acids having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said pickling acids, chrome tanning agents and auxiliary chemicals.

By far the most important type of tanning is the chrome tanning. It is based on the azido-complex formation and the agglomeration of basic chrome salts with collagen carboxyl groups.

Aside from the above also other basic metal salts, such as of iron, aluminum, zirconium, titanium and silicon, have tanning properties. In practice, however, only specified aluminum and zirconium salts have been used as combination tanning matter. Silicon compounds practically have not been used at all, because the raw materials, mostly special water-glasses, are difficult to handle in an acidic tanning medium. Additionally, and specifically after mellowing, the leather quality in most cases is substandard, because hardening, brittle feel and loss of resistance to tearing can occur.

The application of aluminosilicates in combination with dicarboxylic acids and/or tricarboxylic acids and/or their partial esters specifically to chrome tanning and/or combination tanning with chrome, aluminum, and silicon tanning agents produces the following advantages:

(1) By reducing the amount of chrome tanning agents, as well as fostering a high chrome-consumption from the tan liquors, a reduction of the residual chrome content down to 0.2 gm/l chromium oxide can be achieved. Many pollutants are therefore removed from the sewage of tanneries. The sole use of the aluminosilicates already brings a considerable reduction of the residual chrome content of the liquors, which can be considerably improved, however, by the combination of the aluminosilicates with the dicarboxylic acids and/or tricarboxylic acids and/or their partial esters. This high chrome-consumption from the tanning liquors results additionally in a more economical use of the chrome tannings, apart from the improvement in the sewage.

(2) The penetration and distribution of the combination tanning in the skin is increased and the disadvantages of the usual silicon tannings are avoided, since the aluminosilicates dissolve or react in the acid medium with pH value of about 3–4.5 used in tanning to give aluminum salts and polymeric silcas in a very fine distribution.

(3) In combination tanning aluminosilicates have a self-neutralizing effect because of their own consumption of acid. The application of additional neutralizers, therefore, can be relinquished. The tanning liquor on neutralization has improved stability, and the tanning of skins is increased. Altogether the control of the tanning process is more flexible and reliable.

Summarizing it can be said that a better leather quality, an improved economy of the chrome tanning process, and a reduction of environment pollution is achieved by the use of the aluminosilicates according to the invention in combination with dicarboxylic acids and/or tricarboxylic acids and/or their partial esters.

The dicarboxylic and/or tricarboxylic acids or their hydrolyzable partial esters can be used together with the alumino-silicates in the chrome tanning of leather. But the acids or their partial esters can already be added with great advantage to the highly acid pickle, hence before the start of the tanning process proper, since a high chrome content of the leather is achieved with a particularly favorable distribution.

As the dicarboxylic acids and/or tricarboxylic acids according to the invention, the following can be used; aliphatic dicarboxylic acids having from 2 to 8 carbon atoms, aliphatic tricarboxylic acids having from 4 to 8 carbon atoms, aromatic carboxylic acids, particularly benzenecarboxylic acids having from 8 to 10 carbon atoms such as benzenedicarboxylic acids and benzenetricarboxylic acids, such as alkanedioic acids having 2 to 8 carbon atoms, for example, succinic acid, glutaric acid, adipic acid; alkenedioic acids having 2 to 8 carbon atoms, for example, maleic acid, fumaric acid; aminoalkanedioic acids having 3 to 8 carbon atoms, for example, aspartic acid, glutamic acid; phthalic acid; terephthalic acid; and hydroxyalkanetrioic acids having 4 to 8 carbon atoms, for example, citric acid.

In the same manner, the hydrolyzable partial esters of these carboxylic acids with monohydric or polyhydric alcohols with 1 to 6 carbon atoms can be employed particularly aliphatic alcohols having from 1 to 6 carbon atoms and 1 to 6 hydroxyl groups. Such alcohols are, for example, alkanols having 1 to 6 carbon atoms such as methanol, ethanol, n-propanol and iso-propanol, butanols, amyl alcohols; alkanediols having 2 to 6 carbon atoms, such as ethylene glycol, propylene glycol, butylene glycol; alkanetriols having from 3 to 6 carbon atoms such as glycerin, trimethyol propane; alkanetetraols having from 4 to 6 carbon atoms such as pentaerythrite; and sorbitol. Preferred are the mono-esters of the dicarboxylic or tricarboxylic acids, since they hydrolyze relatively fast in the acid medium, e.g. pickling or tanning liquor.

The aluminosilicates to be used according to the invention are amorphous, cyrstalline, synthetic and natural products which meet the above mentioned requirements. Of particular importance are those products where Cat in the above-mentioned formula denotes an alkali metal ion, preferably a sodium ion, x a number from 0.7 to 1.5, y a number from 0.8 to 6, preferably 1.3 to 4, whose average particle size is from 0.1 to 25$\mu$, preferably 1 to 12$\mu$, and which have a calcium binding power according to the Calcium Binding Power Test Method of 20 to 200 mg CaO/gm of anhydrous active substance. Of equal importance are products, which are identical with the above-mentioned products as far as the meaning of Cat, x, y and the calcium binding power is concerned, and which merely differ by a larger average particle size of more than 25$\mu$ to 5 mm.

Such alkali metal aluminosilicates can be produced synthetically in a simple manner, for example, by reaction of water-soluble silicates with water-soluble aluminates in the presence of water. For this purpose, aqueous solutions of the starting materials can be mixed with one another, or a component present in a solid state may be reacted with the other component present in the form of an aqueous solution.

The desired alkali metal aluminosilicates are also obtained by mixing the two components, present in a solid state, in the presence of water. Alkali metal aluminosilicates can also be produced from $$Al(OH)_3,\ Al_2O_3 \text{ or } SiO_2$$

by reaction with alkali metal silicate solution or aluminate solutions, respectively. Finally, substances of this type are also formed from the melt, although, owing to high melting temperatures required and the necessity of converting the melt into finely distributed products, this method appears to be less interesting from an economic viewpoint.

Many of these alkali metal aluminosilicates and their preparation are described in U.S. Pat. No. 4,071,377, as well as in U.S. patent application Ser. No. 458,306, filed Apr. 5, 1974, now abandoned in favor of its continuation Ser. No. 800,308, filed May 25, 1977, now abandoned in favor of its continuation-in-part Ser. No. 956,851, filed Nov. 2, 1978. These alkali metal aluminosilicates as produced by precipitation, or converted to an aqueous suspension in a finely distributed state by other methods, may be converted from the amorphous state into the aged or crystalline state by heating to temperatures of from 50° to 200° C. The amorphous or crystalline alkali metal aluminosilicate, present in an aqueous suspension, can be separated from the remaining aqueous solution by filtration and can be dried at temperatures of, for example, 50° to 800° C. The product contains a greater or smaller quantity of bound water according to the drying conditions. Anhydrous products are obtained by drying for 1 hour at 800° C. However, the hydrous products are preferred, particularly those obtained when drying at 50° to 400° C., particularly 50° to 200° C. Suitable products can have, for example, water contents of approximately 2% to 30%, usually approximately 8% to 27% relative to their total weight.

The precipitation conditions can contribute to the formation of the desired small particle sizes of from 1 to 12$\mu$, the intermixed aluminate and silicate solutions, which may also be introduced simultaneously into the reaction vessel, are subjected to high shearing forces by, for example, intensively agitating the suspension. When crystallized alkali metal aluminosilicates are produced (these are preferably used in accordance with the invention), the formation of large, possibly interpenetrating crystals, is thus prevented by slow agitation of the crystallizing compound.

Nevertheless, undesired agglomeration of crystal particles can occur, particularly during drying, so that it may be advisable to remove these secondary particles in a suitable manner by, for example, air separators. Alkali metal aluminosilicates obtained in a coarser state, and which have been ground to the desired grain size, can be used. By way of example, mills and/or air separators, or combinations thereof, are suitable for this puroose.

Preferred products are, for example, synthetically produced crystalline alkali metal aluminosilicates of the composition.

$$0.7\text{-}1.1M_2O.Al_2O_3.1.3\text{-}3.3SiO_2,$$

in which M represents an alkali metal cation, preferably a sodium cation. It is advantageous if the alkali metal aluminosilicate crystallites have rounded corners and edges.

If it is desired to produce the alklail metal aluminosilicates with rounded corners and edges, it is advantageous to start with a preparation whose molar composition lies preferably in the range.

$$2.5\text{-}6.0M_2O.Al_2O_3.0.5\text{-}5.0SiO_2.60\text{-}200H_2O$$

wherein M has the meaning given above and, in particular, signifies the sodium ion. This preparation is crystallized in a coventional manner. Advantageously, this effected by heating the preparation for at least ½ hour to 70° to 120° C., preferably to 80° to 95° C., under agitation. The crystalline product is isolated in a simple manner by separating the liquid phase. If required, it is advisable to re-wash the products, with water, and to dry them before further processing. Even when working with a preparation whose composition differs only slightly from that stated above, one still obtains products having rounded corners and edges, particularly when the difference only relates to one of the four concentration parameters given above.

Furthermore, fine-particulate water-insoluble alkali metal aluminosilicates may also be used in the method of the invention which have been precipitated and aged or crystallized in the presence of water-soluble inorganic or organic dispersing agents. Products of this type are described in U.S. patent applications Ser. No. 503,467, filed Sept. 5, 1974, now abandoned; Ser. No. 763,667, filed Jan. 28, 1977, now abandoned; and Ser. No. 811,964, filed June 30, 1977, now U.S. Pat. No. 4,126,574. They are obtainable in a technically simple manner. Suitable water-soluble organic dispersing agents are surface-active compounds, non-surface-active-like aromatic sulfonic acids and compounds having a complex-forming capacity for calcium. The said dispersing agents may be introduced into the reaction mixture in an optional manner before or during precipitation, and, for example, they may be introduced in the form of a solution or they may be dissolved in the aluminate solution and/or silicate solution. Particularly satisfactory effects are obtained when the dispersing agent is dissolved in the silicate solution. The quantity of dispersing agent should be at least 0.05 percent by weight, preferably 0.1 to 5 percent by weight, based on the total amount of precipitate obtained. The product of precipitation is heated to temperatures of from 50° to 200° C. for ½ to 24 hours for the purpose of ageing or crystallization. By way of example, sodium lauryl ether sulfate, sodium polyacrylate, hydroxyethane diphosphonate and others may be mentioned from the large number of dispersing agents which may be used.

Compounds of the general formula $$0.7\text{-}1.1Na_2O.Al_2O_3.>2.4\text{-}3.3SiO_2$$

consitute a special variant, with respect to their crystal structure, of the alkali metal aluminosilicates to be used in accordance with the invention.

Compounds of the formula $$0.7\text{-}1.1Na_2O.Al_2O_3>3.3\text{-}5.3SiO_2$$

constitute a further variant of the water-insoluble aluminosilicates to be used in accordance with the invention. The production of such products is based on a preparation whose molar composition lies preferably in the range $$2.5\text{-}4.5Na_2O.Al_2O_3.3.5\text{-}6.5SiO_2.50\text{-}11.0H_2O$$

This preparation is crystallized in a conventional manner. Advantageously, this is effected by heating the preparation for at least ½ hour to 100° to 200° C., preferably to 130° to 160° C., under vigorous agitation. The crystalline product is isolated in a simple manner by separation of the liquid phase. If required, it is advisable to wash the products with water, and to dry them at temperatures of from 20° to 200° C., before further processing. The dried products thus obtained still contain bound water. When the products are produced in the manner described one obtains very fine crystallites which come together to form spherical particles, possibly to form hollow balls having a diameter of approximately 1 to 4$\mu$.

Furthermore, alkali metal aluminosilicates suitable for use in accordance with the invention are those which can be produced from calcinated (destructured) kaolin by hydrothermal treatment with aqueous alkali metal hydroxide. The formula $$0.7\text{-}1.1M_2O.Al_2O_3.1.3\text{-}2.4SiO_2.0.5\text{-}5.0H_2O$$

corresponds to the products, M signifying an alkali metal cation, particularly a sodium cation. The production of the alkali metal aluminosilicates from calcinated kaolin leads, without any special technical expense, directly to a very fine-particulate product. The kaolin, previously calcinated at 500° to 800° C., is hydrothermally treated with aqueous alkali metal hydroxide at 50° to 100° C. The crystallization reaction thereby taking place is generally concluded after 0.5 to 3 hours.

Commercially available, elutriated kaolins predominantly comprise the clay mineral kaolinite of the approximate composition $Al_2O_3.2SiO_2.2H_2O$ and which has a layer structure. In order to obtain the alkali metal aluminosilicates, to be used in accordance with the invention, therefrom by hydrothermal treatment with alkali metal hydroxide, it is first necessary to destructure the kaolin, this being effected to best advantage by heating the kaolin to temperatures of from 500° to 800° C. for two to four hours. The X-ray amorphous anhydrous metakaolin is thereby produced from the kaolin. In addition to destructuring the kaolin by calcination, the kaolin can also be destructured by mechanical treatment (grinding) or by acid treatment.

The kaolins usable as starting materials are light-colored powders of great purity; of course, their iron content of approximately 2000 to 10,000 ppm Fe is substantially higher than the values of from 20 to 100 ppm Fe in the alkali metal aluminosilicates produced by precipitation from alkali metal silicate and alkali metal aluminate solutions. This higher iron content in the alkali metal aluminosilicates produced from kaolin is not disadvantageous, since the iron is firmly bedded in the form of iron oxide in the alkali metal aluminosilicate lattice and is not dissolved out. A sodium aluminosilicate having a cubic, faujasitelike structure is produced during the hydrothermal action of sodium hydroxide on destructured kaolin. Production of such alkali metal aluminosilicates from destructured kaolin with a low iron content are described in U.S. patent application Ser. No. 819,666, filed July 28, 1977, now U.S. Pat. No. 4,089,929.

Alkali metal aluminosilicates, usable in accordance with the invention, may also be produced from calcinated (destructured) kaolin by hydrothermal treatment with aqueous alkali metal hydroxide with the addition of silicon dioxide or a compound producing silicon dioxide. The mixture of alkali metal aluminosilicates of differing crystal structure, generally obtained thereby, comprises very fine-particulate crystal particles having a diameter of less than 20μ, and 100% of which usually comprises particles having a diameter of less than 10μ. In practice, this conversion of the destructured kaolin is effected preferably with aqueous sodium hydroxide and water glass. A sodium aluminosilicate J is thereby produced which is known by several names in the literature, for example, molecular sieve 13× or zeolite NaX (see O. Grubner, P. Jiru and M. Rálek, "Molecular Sieves", Berlin 1968, page 32, 85–89), when the preparation is preferably not agitated during the hydrothermal treatment at all events when only low shearing energies are used and the temperature preferably remains at 10° to 20° C. below the boiling temperature (approximately 103° C.). The sodium aluminosilicate J has a cubic crystal structure similar to that of natural faujasite. The conversion reaction may be influenced particularly by agitating the preparation, at elevated temperature (boiling heat at normal pressure or in an autoclave) and greater quantities of silicate, that is, by a molar preparation ratio $SiO_2$:$Na_2O$ at least 1, particularly 1.0 to 1.45, such that sodium aluminosilicate F is produced in addition to, or instead of, sodium aluminosilicate J. Sodium aluminosilicate F is designated "zeolite P" or "type B" in the literature (see D. W. Breck, "Zeolite Molecular Sieves", New York, 1974, page 72). Sodium aluminosilicate F has a structure similar to the natural zeolites gismondine and garronite and is present in the form of crystallites having an externally spherical appearance. In general, the conditions for producing the sodium aluminosilicate F and for producing mixtures of J and F are less critical than those for a pure crystal type A.

The above-described types of different alkali metal aluminosilicates can also be produced without difficulties in a coarser form with particle sizes of more than 25μ to 5 mm, in addition to the finely-divided form with particles sizes of 0.2 to 25μ. This can be done either by omitting the measures that prevent large crystal growth or agglomeration, or by transforming the finely-divided product subsequently in known manner into the granulated form. The desired particle size can be adjusted subsequently, if desired, by grinding and air sifting.

For use in the manufacture of leather in combination with dicarboxylic and/or tricarboxylic acids, and/or their water-soluble, hydrolyzable, partial esters, aluminosilicates also can be used where Cat in the above formula denotes an alkali metal ion and/or a bivalent and/or trivalent cation, where Cat consists at least of 20% of alkali metal ions, preferably sodium ions, x denotes a number from 0.7 to 1.5, n a number from 1 to 3, y a number from 0.8 to 6, preferably 1.3 to 4, with a particle size of 0.1μ to 5 mm, and a calcium-binding power to 20 to 200 mg CaO/gm of anhydrous active substance when measured according to the Calcium Binding Power Test Method.

For the production of aluminosilicates containing bivalent or trivalent cations, the above-mentioned reactions for the preparation of the alkali metal aluminosilicates can be carried out in some cases with aluminates or silicates which already contain the corresponding cations in salt form. In general, corresponding aluminosilicates are obtained in known manner by ion exchange from alkali metal aluminosilicates with polyvalent cations, e.g. calcium, magnesium, zinc or aluminum ions.

Examples of aluminosilicates, where the alkali metal cations are partly replaced by polyvalent cations, particularly calcium, magnesium, or zinc ions, are represented by the following formulas, bound water not shown;

$0.8CaO.0.2Na_2O.Al_2O_32.SiO_2$, $0.4CaO.0.5Na_2O.Al_2O_3.SiO_2$, $0.18MgO.0.77Na_2O.Al_2O_3.1.9SiO_2$, $0.16MgO.0.8Na_2O.Al_2O_3.2.05SiO_2$, $0.11ZnO.0.92Na_2O.Al_2O_3.2SiO_2$.

The products contain about 8% to 27% by weight of bound water. They can be used in their crystalline, as well as in their amorphous forms.

Other aluminosilicates suitable for use according to the invention are those where Cat in the above formula denotes an alkali metal ion and/or a bivalent and/or trivalent cation, x a number from 0.5 to 1.8, y a number from 0.8 to 6, preferably 1.3 to 4, with a particle size of 0.1μ to 5 mm, and a calcium binding power of 0 to <20 mg CaO/gm of anhydrous active substance.

Among the aluminosilicates of this group are amorphous, crystalline, synthetic and natural products. They can be synthetized in a simple manner, for example, by reacting water-soluble silicates with water-soluble aluminates in the presence of water, as it was described principally in the preceding production methods. As examples of such products we mention the following aluminosilicates:

$1.05Na_2O$, $Al_2O_3.3.8SiO_2$ Ca binding power 0 mg CaO/gm $1.0Na_20.Al_2O_3.2.1SiO_2$ Ca binding power 16 mg CaO/gm $0.05\ Na_2O.0.94CaO.Al_2O_3.1.92SiO_2$ Ca binding power <15 mg CaO/gm $0.09Na_2O.0.82MgO.Al_2O_3.2.38SiO_2$ Ca binding power <15 mg CaO/gm Also, for use according to the invention in the manufacture of leather, suitable aluminosilicates can be employed where Cat in the above formula denotes an alkali metal ion and/or a bivalent and/or trivalent cation, x a number from 0.5 to 1.8, y a number from >6 to 50, preferably >6 to 20, with a particle size of 0.1μ to 5 mm, and a calcium-binding power of 0 to 200 mg CaO/gm anhydrous substance according to the Calcium Binding Power Test Method.

These aluminosilicates can be amorphous or crystalline and be of synthetic or natural origin. They can be synthetized in a simple manner, such as, by reacting water-soluble silicates with water-soluble aluminates in the presence of water. To this end, aqueous solutions of the starting material can be mixed with each other, or one component, which is present in solid form, can be reacted with the other component, which is present as an aqueous solution. The introduction of polyvalent cations can be effected according to methods known from the literature by exchanging monovalent cations, for example, sodium ions, with bivalent and trivalent cations, such as calcium, magnesium, zinc or aluminum ions. The natural aluminosilicates can also contain other cations in a fluctuating, mostly small amount in addition to the above-mentioned cations. Among these are alkali metals such as lithium, potassium; thallium; manganese;

cobalt; and nickel ions. Synthetic aluminosilicates can also contain, as cations, quaternary nitrogen compounds, such as ammonium ions, in varying amounts. The extent to which the aluminosilicates are laden with the above-mentioned cations depends largely on the size of the coefficient of selectivity. Preferably, however, aluminosilicates of the above-indicated general composition are used, where Cat in the above-mentioned formula is an alkali metal ion, preferably a sodium ion. Examples of these products are represented by the following formulas:

$1.3Na_2O.Al_2O_3.13.4SiO_2$ $0.6Na_2O.Al_2O_3.8.3SiO_2$ $1.1Na_2O.Al_2O_3.14.8SiO_2$ $1.5Na_2O.Al_2O_3.12.2SiO_2$ $1.5Na_2O.Al_2O_3.11.8SiO_2$

An essential criterion for the usability of all the above mentioned aluminosilicates according to the invention is their least partial acid solubility in the pH range of 2.5 to 5, preferably 3.5 to 4.5. The products that meet this requirement are at least partly dissolved by a solution of 2.5 ml concentrated formic acid in 100 ml water. This acid solubility test is carried out as follows:

A suspension of 2 gm of aluminosilicates (related to the anhydrous active substance) in 100 ml distilled water is mixed slowly under stirring in the course of 8 to 30 minutes at a temperature of 22° C. with 2 ml of concentrated formic acid. For aluminosilicates that can be used according to the invention, the pH value, of the suspension after the total addition of the 2 mg formic acid must be above 2.5, between 2.5 and 5.5., and preferably between 3.5 and 4.5. If these pH values are attained in the titration, we have an aluminosilicate which is suitable for use according to the invention in view of its acid binding power. Products where a ph value outside this range is found according to this method, have either a too low acid binding power or a too high alkalinity, and are not usable in the sense according to the invention. For strict neutralizing purposes, which are not the subject of the present invention, aluminosilicates with a higher alkalinity can also be used.

The calcium binding power can be determined as follows:

1 liter of an aqueous solution containing 0.594 g $CaCl_2$ (=300 mg CaO/1=30° dH) (German hardness degrees), and standardized with diluted NaOH to a pH value of 10, is mixed with 1 gm of the aluminosilicate, calculated as an ahydrous product. Then the suspension is stirred vigorously for 15 minutes at a temperature of 22° C. After filtering off the aluminosilicate, the residual hardness x of the filtrate is determined, from which the calcium binding power is calculated in mg CaO/gm of aluminosilicate according to the formula (30-x). 10. For short hand purposes the above procedure is hereafter referred to as the Calcium Binding Power Test Method.

The tanning of fur skins and leather is effected in known manner. Pickling and tanning can be combined with each other in known manner. Subsequently the leather is oiled. In chrome tanning, about 10 to 50 gm/l of aluminosilicate, related to the anhydrous product, are used in the tanning liquor. The dicarboxylic and tricarboxylic acids or their water-soluble, hydrolyzable partial esters are used in the tanning liquor in an amount of 1 to 20 gm/l. Preferably adipic acid and glutaric acid or their partial esters are used. In a jointly concurrent pickling and chrome tanning, the acid can already be added in the pickle. The amounts is then likewise about 1 to 20 gm/l liquor. Beyond that the usual active and auxiliary substances, like anionic, cationic or nonionic surface-active compounds or tensides, chrome salts etc. are used both in the tanning liquor and in the pickle.

In the method according to the invention, the concentration of the chromium salts in the tanning liquor can be reduced by 25% to 50% as compared with the standard tanning methods.

The following preparations and examples are illustrative of the practice of the invention without being limitative in any manner.

PREPARATIONS

I. The Production of Suitable Alkali Metal Aluminosilicates

The silicate solution was added to the aluminate solution under vigorous agitation in a vessel having a capacity of 15 liters. Agitation was effected at 3000 r.p.m. by means of an agitator having a dispersing disc. The two solutions were at room temperature. An X-ray amorphous sodium aluminosilicate was formed as a primary product of precipitation with an exothermic reaction. After agitating for 10 minutes, the suspension of the precipitation product was transferred to a crystallizer and, for the purpose of crystallization, remained in the crystallizer for 6 hours at 90° C. under agitation (250 r.p.m.). The mother liquor was drawn off from the crystal sludge and the filtration residue was washed with deionized water until the washing water flowing off had a pH value of approximately 10. Therefore the washed filtration residue was dried as specified. Instead of the dried sodium aluminosilicate, the suspension of the crystallization product or the crystal sludge was also used to produce the auxiliary soaping agents. The water contents were determined by heating the predried products to 800° C. for 1 hour. The sodium aluminosilicates, washed or neutralized to the pH value of approximately 10, and then dried, were subsequently ground in a ball mill. The grain size distribution was determined by means of a sedimentation balance.

Conditions for Producing Sodium Aluminosilicate A

Precipitation:

- 2.985 kg of aluminate solution of the composition: 17.7% $Na_2O$, 15.8% $Al_2O_3$, 66.6% $H_2O$
- 0.15 kg of caustic soda
- 9.420 kg of water
- 2.445 kg of a 25.8% sodium silicate solution of the composition 1 $Na_2O.6.0SiO_2$, freshly prepared from commercially available water glass and slightly alkali-soluble silicic acid Crystallization: 6 hours at 90° C.

Drying: 24 hours at 100° C.

Composition: 0.9 $Na_2O.1Al_2O_3.2.04SiO_2.4.3H_2O$ (=21.6% $H_2O$)

Degree of crystallization: Fully crystalline.

Calcium binding power: 170 mg CaO/gm active substance.

The particle size distribution, determined by sedimentation analysis, resulted in a mixture range of the particle size distribution curve at 3 to 6μ.

The sodium aluminosilicate A exhibits the following interference lines in the X-ray diffraction graph:

d values, photographed with Cu-$K_\alpha$ radiation in Å

I
–
12.4
–
8.6
7.0
–
4.1 (+)
–
3.68 (+)
3.38 (+)
3.26 (+)
2.96 (+)
–
–
2.73 (+)
–
2.60 (+)

It is quite possible that all these interference lines will not appear in the X-ray diffraction graph particularly when the aluminosilicates are not fully crystallized. Thus, the most important d values for characterizing these types have been characterized by a "(+)".

Conditions for Producing Sodium Aluminosilicate B

Precipitation:
- 7.63 kg of an aluminate solution of of the composition 13.2% $Na_2O$; 8.0% $Al_2O_3$; 78.8% $H_2O$;
- 2.37 kg of a sodium silicate solution of the composition 8.0% $Na_2O$; 26.9% $SiO_2$; 65.1% $H_2O$;

Preparation ratio in mol: 3.24 $Na_2O$; 1.0 $Al_2O_3$; 1.78 $SiO_2$; 70.3 $H_2O$;
Crystallization: 6 hours at 90° C.;
Drying: 24 hours at 100° C.;
Composition of the dried product: 0.99 $Na_2O.100\ Al_2O_3.1.83SiO_2.\ 4.0H_2O$; (=20.9% $H_2O$)
Crystalline form: Cubic with greatly rounded corners and edges;
Average particle diameter: 5.4μ
Calcium binding power: 172 mg CaO/gm active substance.

Conditions for producing sodium aluminosilicate C

Precipitation:
- 12.15 kg of an aluminate solution of the composition 14.5% $Na_2O$; 5.4% $Al_2O_3$; 80.1% $H_2O$;
- 2.87 kg of a sodium silicate solution of the composition 8.0% $Na_2O$; 26.9% $SiO_2$; 65.1% $H_2O$;

Preparation ratio in mol: 5.0 $Na_2O$; 1.0 $Al_2O_3$; 2.0 $SiO_2$; 100 $H_2O$;
Crystallization: 1 hour at 90° C.;
Drying: Hot atomization of a suspension of the washed product (pH 10) at 295° C.; Content of solid substance in the suspension 46%;
Composition of the dried product 0.96 $Na_2O.1Al_2O_3.1.96SiO_2.4H_2O$;
Crystalline form: Cubic with greatly rounded corners and edges; Water content 20.5%;
Average particle diameter: 5.4μ
Calcium binding power: 172 mg CaO/gm active substance.

Conditions for Producing Potassium Aluminosilicate D

The sodium aluminosilicate C was produced in the first instance. After the mother liquor had been drawn off, and the crystalline mass had been washed to the pH value 10 with demineralized water, the filtration residue was suspended in 6.1 l of a 25% KCl solution. The suspension was heated for a short time to 80° to 90° C., and was then cooled, filtered off again and washed.
Drying: 24 hours at 100° C.;
Composition of the dried product: 0.35 $Na_2O.0.66\ K_2O.1.0Al_2O_3\ 1.96\ SiO_2.4.3H_2O$; (water content 20.3%)

Conditions for Producing Sodium Aluminosilicate E

Precipitation:
- 0.76 kg of aluminate solution of the composition: 36.0% $Na_2O$, 59.0% $Al_2O_3$, 5.0% water
- 0.94 kg of caustic soda;
- 9.94 kg of water;
- 3.94 kg of a commercially available sodium silicate solution of the composition: 8.0% $Na_2O$, 26.9% $SiO_2$, 65.1% $H_2O$;

Crystallization: 12 hours at 90° C.;
Drying: 12 hours at 100° C.;
Composition: 0.9 $Na_2O.1\ Al_2O_3.3.1\ SiO_25.\ H_2O$;
Degree of crystallization: Fully crystalline.
The maximum range of the particle size distribution curve at 3 to 6μ.
Calcium binding power: 110 mg CaO/gm active substance.

The aluminosilicate E exhibited the following interference lines in the X-ray diffraction graph:
d-values, photographed with Cu-$K_\alpha$ radiation in Å

14.4
–
8.8
–
–
4.4
–
3.8
–
–
–
–
2.88
2.79
–
2.66
–

Conditions for Producing Sodium Aluminosilicate F

Precipitation:
- 10.0 kg of an aluminate solution of the composition: 0.84 kg $NaAlO_2$+0.17 kg NaOH+1.83 kg $H_2O$;
- 7.16 kg of a sodium silicate solution of the composition 8.0% $Na_2O$, 26.9% $SiO_2$, 65.1% $H_2O$;

Crystallization: 4 hours at 150° C.;
Drying: Hot atomization of a 30% suspension of the washed product (pH 10);
Composition of the dried product: 0.98 $Na_2O.1\ Al_2O_3.4.12\ SiO_2.4.9\ H_2O$;
The particles were of spherical shape; the average diameter of the balls was approximately 3 to 6μ.
Calcium binding power: 132 mg CaO/gm active substance at 50° C.

Conditions for Producing Sodium Aluminosilicate G

Precipitation:
- 7.31 kg aluminate (14.8% $Na_2O$, 9.2% $Al_2O_3$, 76.0% $H_2O$)
- 2.69 kg silicate (8.0% $Na_2O$, 26.9% $SiO_2$, 65.1% $H_2O$);

Preparation ratio in mol: 3.17 $Na_2O$, 1.0 $Al_2O_3$, 1.82 $SiO_2$, 62.5 $H_2O$;
Crystallization: 6 hours at 90° C.;
Composition of the dried product: 1.11 $Na_2O.1$ $Al_2O_3.1.89$ $SiO_2$, 3.1 $H_2O$ (=16.4% $H_2O$);
Crystalline structure: Mixed structural type in the ratio 1:1,
Crystalline form: Rounded crystallites;
Average particle diameter: 5.6μ.
Calcium binding power: 105 mg CaO/gm active substance at 50° C.

Conditions for Producing Sodium Aluminosilicate H Produced from Kaolin

1. Destructuring Kaolin

In order to activate the natural kaolin, samples of 1 kg were heated to 700° C. in a Schammote crucible for 3 hours. The crystalline kaolin $Al_2O_3.2$ $SiO_2.2$ $H_2O$ was thereby converted to the amorphous metakaolin $Al_2O_3.2$ $SiO_2$.

2. Hydrothermal treatment of metakaolin

The alkali solution was placed in an agitating vessel and the calcined kaolin was added under agitation at temperatures between 20° and 100° C. The suspension was brought to the crystallization temperature of 70° to 100° C. under agitation, and was maintained at this temperature until the crystallization operation had terminated. The mother liquor was subsequently drawn off and the residue was washed with water until the washing water draining off had a pH value of from 9 to 11. The filter cake was dried and was subsequently crushed to a fine powder or was ground to remove the agglomerates produced during drying. This grinding process was omitted when the filtration residue was further processed in a wet state or when the drying operation was performed by means of a spray dryer or a flow dryer. Alternatively, the hydrothermal treatment of the calcined kaolin can be performed in a continuous operation.

Preparation:
1.65 kg of calcined kaolin
13.35 kg of 10% NaOH, mixed at room temperature;
Crystallization: 2 hours at 100° C.;
Drying: 2 hours at 160° C. in a vacuum drying cabinet;
Composition: 0.88 $Na_2O.1$ $Al_2O_3.2.14$ $SiO_2$ 3.5 $H_2O$ (=18.1% $H_2O$);
Crystalline structure: Mixed structural type like Na aluminosilicate G, although in the ratio 8:2.
Average particle diameter: 7.0μ.
Calcium binding power: 126 mg CaO/gm active substance.

Conditions for Producing Sodium Aluminosilicate J Produced from Kaolin

The destructuring of the kaolin and the hydrothermal treatment were effected in the same manner as in the case of H.

Preparation:
2.6 kg of calcined kaolin,
7.5 kg of 50% NaOH,
7.5 kg of water glass,
51.5 kg of deionized water, mixed at room temperature;
Crystallization: 24 hours at 100° C., without agitation;
Drying: 2 hours at 160° C. in a vacuum drying cabinet;
Composition: 0.93 $Na_2O.1.0$ $Al_2O_3.3.60$ $SiO_2.6.8$ $H_2O$ (=24.6% $H_2O$);
Crystalline structure: Sodium aluminosilicate J in accordance with above definition, cubic crystallites;
Average particle diameter: 8.0μ
Calcium binding power: 105 mg CaO/gm active substance.

Preparation of Sodium Aluminosilicate K in Granulated Form

For the preparation of the granulated alkali metal aluminosilicates utilizable according to the invention, dried, finely-divided crystalline aluminosilicates which still contained 15 to 25% bound water were employed as starting materials.

50 kg of a powdered, crystalline, dried aluminosilicate of the composition 0.9 mole $Na_2O.1$ mole $Al_2O_3.2.04$ moles $SiO_2.4.3$ moles $H_2O$ (aluminosilicate A), were suspended in a 300 l agitator vessel with 180 l water, and standardized to a pH value of 6 with 25% hydrochloric acid. This suspension was stirred moderately for 40 minutes. Then the aluminosilicate was separated on a vacuum filter, and the filter cake was washed out three times with 20 l water each. The aluminosilicate was dried in a drying cabinet for 10 hours at 105° C.

This dried aluminosilicate was mixed with 10 kg of bentonite and 20.1 kg of water, which had been standardized to a pH value of 6 with 25% hydrochloric acid, and the mixture was homogenized for 20 minutes in a 100 kg "Loedige" mixer (blade mixer by Loedige). Under continued mixing and gradual addition of 13.5 kg of additional water, which had likewise been standardized to a pH of 6 with 25% hydrochloric acid, within another 8 minutes the desired granulated product was obtained.

The granulated material was dried in a drying cabinet for 60 minutes at 150° C. and solidified by subsequent heating (15 minutes at 780° C.).

In order to determine the exchange power, 1 gm of the granulated material was boiled in 500 ml tap water of 16° dH for 5 minutes. After cooling and filtering, the residual hardness of the resultant filtrate was determined as discussed above. The calcium binding power of the product was 120 mg CaO/gm active substance. The particle size was 0.08 to 2 mm.

When an Eirich turbo mixer (pan/turbo mixer by Eirich) was used, the required homogenization and granulation periods were shorter. When the above-described procedure was used for the preparation of sodium aluminosilicate A in granulated form, the homogenization and the granulation were already completed after 5 minutes (instead of 28 minutes in the blade mixer). After drying for 15 minutes at 100° C. and calcining for 5 minutes at 800° C. in an air muffle furnace, a granulated product was obtained with a good exchange power, good hot water resistance, and good grain stability.

The calcium binding power of the product was 110 mg CaO/gm of active substance. The particle size was 0.08 to 2 mm.

In a corresponding manner, other granulated products of alkali metal aluminosilicates can also be prepared with particle sizes of more than 25μ to 5 mm, if alkali metal aluminosilicates of the types B to J are treated according to the above-described procedure.

Other granulating methods, like those described in U.S. Pat. No. 3,356,450 and German Pat. No. 1,203,238 are also suitable for the preparation of the alkali metal aluminosilicates to be used according to the invention.

Preparation of Aluminosilicate L

A product of the composition 0.98 $Na_2O.Al_2O_3.1.96$ $SiO_2.4.2$ $H_2O$, prepared according to the instructions for alkali metal aluminosilicate C, was suspended in a solution containing calcium chloride. Under exothermic reaction, sodium was exchanged against calcium. After a reaction time of 15 minutes, the product was filtered off and washed, then spray-dried at an atomization temperature of 198° to 250° C. by hot atomization of a 40% suspension. The product obtained had the following characteristics:

Composition: 0.28 $Na_2O$0.7 $CaO.Al_2O_3.1.96$ $SiO_2.4$ $H_2O$
Calcium binding power: >20 mg CaO/gm of active substance
Particle size: Mean particle diameter: 5.8μ
Crystal form: A-type, crystalline Preparation of Aluminosilicate M An aluminosilicate of the composition 0.89 $Na_2O.Al_2O_3.2.65$ $SiO_2.6$ $H_2O$ was suspended in a solution containing magnesium chloride. After a reaction time of 30 minutes at 80° to 90° C., the product was filtered off and washed. The drying was effected as shelf-drying for 16 hours at 100° C. The product obtained had the following characteristics:

Composition: 0.52 $Na_2O$0.47 $MgO.Al_2O_3.2.61$ $SiO_2.5.6$ $H_2O$
Calcium binding power: >25 mg CaO/gm of active substance
Particle size: Average particle diameter: 10.5μ

Preparation of Aluminosilicate N

An X-ray amorphous aluminosilicate of the composition 1.03 $Na_2O.Al_2O_3.2.14$ $SiO_2.5.8$ $H_2O$ was treated in the manner described under aluminosilicate M in a solution containing zinc sulfate; subsequently it was washed and dried under mild conditions. The product obtained had the following characteristics:

Composition: 0.92 $Na_2O$0.11 $ZnO.Al_2O_3.1.98$ $SiO_2.6$ $H_2O$
Calcium binding power: 76 mg CaO/gm of active substance
Particle size: Average particle diameter: 36μ

Preparation of Aluminosilicate O 50 kg of aluminosilicate L were suspended in a 300 l agitator vessel with 180 l water and standardized with 25% hydrochloric acid to a pH of 6. The suspension was stirred moderately vigorously for 40 minutes. Then the aluminosilicate was filtered off, washed repeatedly with water and dried for 10 hours at 105° C. The dried aluminosilicate was mixed with 10 kg of bentonite, and 20 l of water, which had been standardized with 25% hydrochloric acid to a pH of 6, and homogenized in a 100 kg blade mixer for 20 minutes. A granulated product was obtained within another 8 minutes under stirring, by adding gradually 13.5 l water, which had been standardized to a pH of 6. The granulated product was dried for 60 minutes at 150° C. and solidified by heating for 15 minutes to 780° C. The particle size distribution of the aluminosilicate O thus obtained was from 1 to 2 mm.

Preparation of Aluminosilicate P

In a vessel of 1.5 l capacity, were charged 80 gm of a 15% solution of hexadecyl-trimethyl-ammonium chloride and 140 gm of a 35% sodium silicate ($Na_2O$: $SiO_2$=1:3.4), dissolved in 550 ml water. Under vigorous mixing, 46 gm of sodium aluminate (38% $Na_2O$, 52% $Al_2O_3$), dissolved in 150 ml water, and immediately thereafter 43.9 gm of $MgSO_4.7$ $H_2O$, dissolved in 100 gm of water, were added. After stirring for 3 hours, the product thus formed was filtered off, washed with water, and the filter residue was dried for 35 hours at 100 torr and 80° C. The product obtained had the following characteristics:

Composition: 0.6 $Na_2O$.0.24 MgO.0.83 $Al_2O_3.2.0$ $SiO_2.4.8$ $H_2O$ and 7% hexadecyl-trimethyl-ammonium chloride
Calcium binding power: 84 mg CaO/gm of active substance
Particle size: Average particle diameter: 16μ (after grinding)

Preparation of Aluminosilicate Q

In a vessel of 1.5 l capacity were charged 142.9 gm of a 35% sodium silicate ($Na_2O$: $SiO_2$=1:3.4), dissolved in 507.4 gm of water, and mixed under stirring with 48.3 gm of sodium aluminate (38% $Na_2O$, 52% $Al_2O_3$), dissolved in 150 gm of water. Subsequently 42.4 gm of $Al_2(SO_4)_3.18$ $H_2O$, dissolved in 100 gm of water, were added and then, after stirring for 10 minutes, 8 gm of a 50% solution of sodium dodecyl-benzene sulfonate were added. After stirring for another 160 minutes, the suspension was treated as described under aluminosilicate P. The product obtained of the composition 1.0 $Na_2O.Al_2O_3.2.1$ $SiO_2.4.1$ $H_2O$ with 2.1% sodium dodecyl-benzene sulfonate, with a calcium binding power of 128 mg CaO/gm of active substance and an average particle diameter of 19μ, was treated for 30 minutes at 60° C. with a diluted aluminum sulfate solution. After filtration, washing and subsequent drying at 80 torr and 100° C. for 6 hours, the solid substance was ground. The product obtained had the following characteristics:
Composition: 0.59% $Na_2O.1.1$ $Al_2O_3.1.98$ $SiO_2.4.9$ $H_2O$
Calcium binding power: 56 mg CaO/gm of active substance
Particle size: Average particle diameter: 50μ

The aluminosilicates, where cat in the above formula denotes an alkali metal ion and/or a bivalent and/or trivalent cation, x a number from 0.5 to 1.8, where the particle size is 0.1μ to 5 mm, y denotes, on the one hand, a number from 0.8 to 6 with a calcium binding power of 0 to <20 mg and, on the other hand, a number from >6 to 50 with a calcium binding power of 0 to 200 mg CaO/gm of anhydrous active substance, can be prepared principally in the same manner as indicated in the above-described production methods. Beyond that, a part of the products are naturally occurring aluminosilicates.

Preparation of Aluminosilicate R

In a vessel of 15 l capacity, an aluminate solution of the composition 0.84 kg $NaAlO_2$, 0.17 kg NaOH, 1.83 kg $H_2O$, was mixed with 7.16 kg of a sodium silicate solution (8.0% $Na_2O$, 26.9% $SiO_2$, 65.1% $H_2O$). The stirring was done with a beam stirrer at 300 rpm. Both solutions were charged at room temperature. An X-ray amorphous sodium aluminosilicate was formed as a primary precipitation product. After stirring for 10 minutes, the suspension of the precipitation product was transferred to a crystallization vessel in which it remained for 8 hours under vigorous stirring (500 rpm) at 150° C. to effect the crystallization. After draining the liquor from the crystal sludge and washing with water until the outflowing water had a pH of about 11, the about 36% suspension of the washed product was dried by hot atomization. The product obtained, a synthetic crystalline zeolite (Analcite), had the following characteristics:

Composition: 1.05 $Na_2O.Al_2O_3.3.8\ SiO_2$
Calcium binding power: 0 mg CaO/gm of active substance
Average particle diameter: 12.3μ

Preparation of Aluminosilicate S

The preparation was similar to that indicated for aluminosilicate R, except that 6.91 kg of aluminate (18.0% $Na_2O$, 11.2% $Al_2O_3$, 70.8% $H_2O$) and 3.09 kg of silicate (8.0% $Na_2O$, 26.9% $SiO_2$, 65.1% $H_2O$) were used for the precipitation. The crystallization of the precipitation product was effected at 100° C. for 4 hours. After washing, the filter cake was dried for 24 hours at 100° C. and subsequently crushed to a fine powder. The product obtained, a feldsparoid hydrosodalite, had the following characteristics:

Composition: 1 $Na_2O.Al_2O_3.2.1\ SiO_2$
Calcium binding power: 16 mg CaO/gm of active substance
Average particle diameter: 6.1μ

Preparation of Aluminosilicate T

For the preparation of the aluminosilicate containing calcium ions, the 44% suspension of a crystalline sodium aluminosilicate of the composition 1.05 $Na_2O.Al_2O_3.1.93\ SiO_2$ was reacted with a concentrated calcium chloride solution. After filtering off the product laden with about 70% calcium, this process was repeated at 60° C. After drying, the product obtained had the following characteristics:

Composition: 0.05 $Na_2O.0.94\ CaO.Al_2O_3.1.92\ SiO_2$
Active substance content: 79%
Calcium binding power: <15 mg CaO/gm of active substance Preparation of Aluminosilicate U For the preparation of the aluminosilicate containing magnesium ions, a 40% suspension of a crystalline sodium aluminosilicate of the composition 0.92 $Na_2O.Al_2O_3.2.39\ SiO_2$ was reacted with a concentrated magnesium sulfate solution at 80° to 90° C. for 30 minutes. After filtering off the product laden with magnesium, the treatment was repeated again. After drying, the product had the following characteristics:

Composition: 0.09 $Na_2O.0.82\ MgO.Al_2O_3.2.38\ SiO_2$
Active substance content: 78%
Calcium binding power: <15 mg CaO/gm of active substance Preparation of Aluminosilicate V This aluminosilicate is a synthetic zeolite (Mordenite) where y has a value of >6 according to the abovementioned formula. The preparation of these aluminosilicates is described more in detail in the monography by Donald W. Breck, "Zeolites, Molecular Sieves", Wiley & Sons, New York. The synthetic Mordenite is prepared from the reaction components sodium aluminate and silica, at temperatures between 265° and 295° C. for 2 to 3 days and yields a product of the following composition:

$$1.0\ Na_2O.Al_2O_3.10\ SiO_2.6.7\ H_2O$$

Other aluminosilicates, where y has a value of >6 according to the above-mentioned formula, are characterized below by commercial products.

Aluminosilicate W

Commercial amorphous aluminosilicate, type "Zeolex 23 A" by Huber Corp.

Composition: 1.5 $Na_2O.Al_2O_3.12.2\ SiO_2$
Active substance content: 82%
Calcium binding power: 40 mg CaO/gm of active substance Aluminosilicate X Commercial amorphous aluminosilicate type "Zeolex 35 P" by Huber Corp.

Composition: 1.5 $Na_2O.Al_2O_3.11.8\ SiO_2$
Active substance content: 82%
Calcium binding power: 46 mg CaO/gm of active substance Aluminosilicate Y Commercial amorphous aluminosilicate, type "Silteg P 820" by Degussa.

Composition: 1.1 $Na_2O.Al_2O_3.14.8\ SiO_2$
Active substance content: 80%
Calcium binding power: 36 mg CaO/gm of active substance Aluminosilicate Z Natural zeolite (Clinoptilolite), as it is obtained in large quantities in open pit mining in the Western part of the United States.
Composition: 0.6 $Na_2O.Al_2O_3.8.3\ SiO_2$
Active substance content: 86%
Calcium binding power: 0 mg CaO/gm of active substance Other examples of natural aluminosilicates that can be used according to the invention, where y has a value of >6 according to the above-mentioned formula, are the following commercial products by Anaconda Co. Denver, Colo., USA.

Anaconda, natural zeolite

Type 1010: molar ratio $SiO/Al_2O_3=9.8$
Type 2020: molar ratio $SiO/Al_2O_3=11.4$
Type 3030: molar ratio $SiO/Al_2O_3=9.0$
Type 4040: molar ratio $SiO/Al_2O_3=7.4$ The following examples will illustrate the subject of the invention further without limiting it, however, to these examples.

EXAMPLES

Example 1

Chrome Tanning of Furniture Leather

Dehaired cowhides, limed, delimed and bated in known manner, were pickled after brief rinsing at 20° C. in the following manner (pickling and tanning jointly):

The hides were left running at 20° C. in the vat for 10 minutes with

100% water
7% common salt

Subsequently 0.5% technical adipic acid
0.7% sulfuric acid (96%)

were added with an addition running time of 2 hours. Then the hides were left standing in the bath overnight (pH 3.8 in the cross section of the hides). After an additional running time of 30 minutes 2% of an electrolyte-resistant fatting agent, based on sulfited natural oils, and
1% of an emulsifier, an anionic tenside, for example, the ammonium salt of a $C_{12}$–$C_{18}$-alkyl sulfate were added, with an additional running time of 30 minutes without changing the liquor. Then 6% of a basic chrome tanning salt, for example, Chromosal B by Bayer AG, were added and left running for 90 minutes. Subsequently
3% aluminosilicate A were added, after which the product was treated for 4 hours in the vat. Instead of aluminosilicate A, the above-mentioned aluminosilicates B to Z can be used with equally or substantially equally good results. The end pH value of the liquor is 4.1 to 4.2. The residual chrome content of the liquor is 0.3 to 0.9 mg/l of chromium oxide. If the tanning is effected according to conventional chrome tanning methods, the residual chrome content is 7 to 11 gm/l of chromium oxide.

The percentages relate in pickling to the pickled weight and in tanning to the weight of the hides.

After completion, a uniformly tanned leather was obtained which was soft like cloth, with a chrome content corresponding to 4.0% chromium oxide, based on the leather with a 0% water content.

Example 2

Chrome Tanning of Cowhide Uppers

Dehaired cowhides, limed, delimed and bated in known manner, were treated after brief rinsing 20° C. in the following manner (pickling and tanning jointly).

The hides were left running at 22° C. in the vat for 10 minutes with

100% water 7% common salt.

Subsequently 0.8% of a mixture of technical aliphatic dicarboxylic acid (alkanedioic acids having 4–8 carbon atoms) and
0.7% sulfuric acid (96%)

were added, with an additional running time of 2 hours. Then the hides were left standing in the bath overnight (pH 3.7 in the cross section of the hides). After an additional running time of 30 minutes 0.5% of an emulsifier, an anionic tenside, for example, the ammonium salt of a $C_{12}$–$C_{18}$-alkyl sulfate were added, with an additional running time of 30 minutes, then 6% of a basic chrome tanning agent (basicity 33% = 1.75% chromium oxide), Chromosal B by Bayer AG, were added, and left running for 90 minutes. Then
3% aluminosilicate H were added and treated again for 90 minutes under slow heating to 35° to 40° C.

Instead of aluminosilicate H the above-mentioned aluminosilicates A-G and J-Z can be used with the same or substantially the same good results.

The end pH value of the liquor is 4.1 to 4.3. The residual chrome content of the liquid is 0.2 to 0.9 gm/l of chromium oxide. But the residual chrome content in the conventional tanning methods is between 7 and 11 gm/l of chromium oxide.

After completion, a soft and full upper leather was obtained with a good feed and a chrome content of 4.3% of chromium oxide, based on the leather with 0% water content.

Example 3

Production of Furniture Cowhide

Dehaired cowhides, limed and delimed in known manner, with a hide thickness of 1.6 to 1.8 mm were rinsed for 15 minutes with water at 35° C. For bating, the hides were milled for 30 minutes at 35° C. in the vat with 200% water
1.5% ammonium sulfate
0.3% acetic acid After adding 1% of a commercial enzyme bate, such as Oropon O by Röhm, the milling was continued for 60 minutes. The pH value in the hide is 7.8 to 8.0. Subsequently the hides were rinsed for 15 minutes with water at 22° C. and left running at first 10 minutes at 22° C. for the pickle treatment with 100% water
8% common salt and then for another 2 hours in the vat after adding 0.9% sodium salt of the methyl half-ester of technical glutaric acid,
0.8% sulfuric acid (96%)

The pH value in the hide was 3.5.

For the following treatment, the hides were treated at first for 30 minutes in the vat with 2% of a commercial electrolyte-resistant fatting agent, such as chloroparaffin sulfonate, then left running for another 2½ hours. after the addition of 1.5% chromium oxide in the form of a commercial basic chrome tanning salt, such as Chromosal B. Bayer AG, and then for another 4 hours, after the addition of 2.6% aluminosilicate K.

Instead of aluminosilicate K, the above-mentioned aluminosilicates A-J and L-Z can also be used with equally or substantially equally good results.

The end pH value of the liquor is 4.0 to 4.2. The residual chrome content of the liquor is 0.2 to 0.8 gm/l of chromium oxide, comparing to a residual chrome content of 7 to 11 gm/l of chromium oxide in conventional tanning methods.

After completion, a soft furniture leather of good quality and feel was obtained with a chrome content corresponding to 4.2% of chromium oxide, based on leather with a 0% water content.

Example 4

Manufacture of Cowhide Uppers

Unsplit cowhides, limed and delimed in known manner, with a hide thickness of over 4 mm were rinsed for 15 minutes with water at 35° C. For bating, the hides were milled for 45 minutes in the vat with 200% water
2% ammonium sulfate
0.5% acetic acid.

After adding 0.5% of a commercial enzyme bate, such as Oropon O, by Röhm, the milling was continued for 30 minutes. The pH value of the hide was 8.0. Subsequently the hides were rinsed for 15 minutes with water at 22° C. and left running for 10 minutes at 22° C. with 100% water
8% common salt for the pickle treatment, then for another two hours in the vat, adding 1.0% sodium salt of adipic acid methyl half-ester
0.6% sulfuric acid (96%)

The pH value of the hides was 3.6.

For the following tanning, the hides were left running with 1.5% chromium oxide in the form of a commercial basic chrome tanning salt, such as Chromosal B, Bayer AG for another 4 hours, and after the addition of 1.5% aluminosilicate P for another 3 hours. The leathers were left standing in the liquor overnight and moved now and then. Instead of aluminosilicate P, the above-mentioned aluminum silicates A-O and Q-Z can also be used with equally or substantially equally good results.

The residual chrome content of the liquor is 0.2 to 0.7 gm/l of chromium oxide, compared to a residual chrome content of 7 to 11 gm/l of chromium oxide with conventional tanning methods.

Example 5

Chrome Tanning of Furniture Leather

Dehaired cowhides, limed, delimed and bated in known manner, were pickled after brief rinsing at 20° C. in the following manner (pickling and tanning jointly):

The hides were left running in the vat for 10 minutes at 20° C. with

100% water
7% common salt

Then 0.6% glutaric acid
0.7% sulfuric acid (96%)

were added, with an additional running time of 2 hours. Then the hides were left standing overnight in the bath (pH 3.8 in the cross section of the hides). After another running time of 30 minutes, 2% of an electrolyte resistant fatting agent, based on sulfited natural oils, and
1% of an emulsifier, an anionic tenside, such as the ammonium salt of a $C_{12}$–$C_{18}$-alkyl sulfate were added with an additional running time of 30 minutes, without changing the liquor. Then 6% of a basic chrome tanning salt, such as Chromosal B by Bayer AG, were added and left running for 90 minutes. Subsequently 3% aluminosilicate N are added, and again treated in the vat for 4 hours. Instead of aluminosilicate N, the above-mentioned aluminum silicates A-M and Q-Z can be used with equally or substantially equally good results.

The residual chrome content of the liquor is 0.2 to 0.8 gm/l of chromium oxide, compared to a residual chrome content of 7 to 11 gm/l of chromium oxide in conventional chrome tanning.

After completion, a uniformly tanned leather, soft like a cloth was obtained with a chrome content corresponding to 4.02% of chromium oxide, based on leather with a 0% water content.

Example 6

Manufacture of Furniture Cowhide

Dehaired cowhides, limed and delimed in known manner, with a hide thickness of 1.6 to 1.8 mm were rinsed for 15 minutes with water at 35° C. For bating, the hides were milled in the vat for 30 minutes at 35° C. with 200% water
1.5% ammonium sulfate
0.3% acetic acid After adding 1% of a commercial enzyme bate, such as Oropon O by Röhm, the hides were milled for another 60 minutes. The pH value in the hide is 7.8 to 8.0. Subsequently the hides were rinsed for 15 minutes with water at 22° C. and left running for 10 minutes at 22° C. with 100% water
8% common salt for the pickle treatment, and after adding 0.9% sodium salt of glutaric acid isopropyl half-ester
0.8% sulfuric acid (96%)

the hides were left running in the vat for another 2 hours. The pH value in the hide is 3.5.

For tanning, the hides were treated first for 30 minutes in the vat with

2% of a commercial electrolyte resistant fatting agent, such as chloroparaffin sulfonate, then left running for another 2½ hours after adding 1.5% chromium oxide in the form of a commercial basic chrome tanning salt, such as Chromosal B, Bayer, AG, and for another four hours after adding 2.6% aluminosilicate D.

Instead of aluminosilicate D, the above-mentioned aluminosilicate A-C and E-Z can be used with equally or substantially equally good results.

The end pH value of the liquor is 4.0 to 4.2. The residual chrome content of the liquor is 0.2 to 0.7 gm/l chromium oxide as compared to a residual chrome content of 7 to 11 gm/l of chromium oxide in conventional tanning methods.

After completion a high quality, soft furniture leather of good feel was obtained with a chrome content corresponding to 4.1% of chromium oxide, based on leather with a 0% water content.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In the process of tanning for the production of leather comprising subjecting uncured hides to the action of an aqueous liquor at a pH of about 3 to 4.5 containing (1) chemical tanning agents, and (2) auxiliary chemicals to tanning and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C., in combination with a polycarboxylate selected from the group consisting of aliphatic dicarboxylic acids having from 2 to 8 carbon atoms, aliphatic tricarboxylic acids, having from 4 to 8 carbon atoms, benzenedicarboxylic acids, benzenetricarboxylic acids and hydrolyzable esters thereof with aliphatic alcohols having from 1 to 6 carbon atoms and 1 to 6 hydroxyl groups, as partial replacement of said chemical tanning agents and said auxiliary chemicals to tanning.

2. The process of claim 1 wherein Cat represents an alkali metal, n is 1, x is an integer from 0.7 to 1.5, y is an integer from 0.8 to 6, said average partical size is from 0.1 to 25μ and said calcium binding power is from 20 to 200 mg CaO/gm of anhydrous active substance.

3. The process of claim 2 wherein said alkali metal is sodium, y is an integer from 1.3 to 4 and said average particle size is from 1 to 12μ.

4. The process of claim 1 wherein Cat represents an alkali metal, n is 1, x is an integer from 0.7 to 1.5, y is an integer from 0.8 to 6, said average particle size is from more than 25μ to 5 mm and said calcium binding power is from 20 to 200 mg CaO/gm of anhydrous active substance.

5. The process of claim 4 wherein said alkali metal is sodium and y is an integer from 1.3 to 4.

6. The process of claim 1 wherein Cat represents a cation mixtures of at least 20% of alkali metals and at least 5% of at least one bivalent metal ion and/or trivalent metal ion.

7. The process of claim 6 wherein x represents an integer from 0.7 to 1.5, y represents an integer from 0.8 to 6, said calcium power is from 20 to 200 mg CaO/gm of anhydrous active substance.

8. The process of claim 7 wherein said alkali metal is sodium and y represents an integer from 1.3 to 4.

9. The process of claim 1 wherein y represents an integer from 0.8 to 6 and said calcium binding power is from 0 to 20 mg CaO/gm of anhydrous active substance.

10. The process of claim 9 wherein y represents an integer from 1.3 to 4.

11. The process of claim 1 wherein y represents an integer from >6 to 50.

12. The process of claim 11 wherein y represents an integer from >6 to 20.

13. The process of claim 1 wherein Cat represents a cation selected from the group consisting of sodium, potassium, calcium, magnesium, zinc, aluminum, and mixtures thereof.

14. The process of claim 1 wherein said water-insoluble aluminosilicates have at least partial water solubility at a pH in the range of 2.5 to 5.

15. The process of claim 14 wherein said pH range is from 3.5 to 4.5.

16. The process of claim 14 wherein said aluminosilicates have a calcium binding power of from 0 to <20 mg/CaO/gm of anhydrous, active substance.

17. The process of claim 16 wherein said partial solubilities is in a solution of 2.5 ml of concentrated formic acid in 100 ml of water.

18. The process of claim 17 wherein said partial solubility is such that said aluminosilicates give a pH value of from 2.5 to 5 in a suspension on slow titration under stirring in the course of from 8 to 30 minutes at a temperature of 22° C. of a suspension of 2 gm of said aluminosilicates (based on the anhydrous active substance) in 100 ml of distilled water, by 2 ml of concentrated formic acid.

19. The process of claim 18 wherein said pH value is from 3.5 to 4.5.

20. The process of claim 1 wherein said polycarboxylate is adipic acid.

21. The process of claim 1 wherein said aluminosilicate is employed in an amount of from 10 to 50 gm/l, based on the anhydrous active substance and said polycarboxylate is employed in an amount of from 1 to 20 gm/l.

22. In the process of pickling and chrome tanning of dehaired hides comprising subjecting dehaired hides to the action of an aqueous liquor containing (1) pickling acids, (2) chrome tanning agents, and (3) auxiliary chemicals to pickling and tanning, rinsing and recovering chrome tanned hides, the improvement consisting essentially of employing a water-insoluble aluminosilicate, containing bound water of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C., in combination with a polycarboxylate selected from the group consisting of aliphatic dicarboxylic acids having from 2 to 8 carbon atoms, aliphatic tricarboxylic acids, having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said pickling acids, chrome tanning agents and auxiliary chemicals.

23. The process of claim 22 wherein said aluminosilicate is employed in an amount of from 10 to 50 gm/l, based on the anhydrous active substance and said polycarboxylate is employed in an amount of from 1 to 20 gm/l.

24. In the process of pickling and tanning uncured hides comprising subjecting uncured hides to the action of an aqueous liquor containing pickling agents and thereafter basic chrome salt tanning agents, tanning auxiliaries for a time sufficient to tan said hides, rinsing and recovering leather, the improvement consisting essentially of employing a water-insoluble aluminosilicate, containing bound water of the formula $$(Cat_{2/n}O)_x \cdot Al_2)_3 \cdot (SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C., in combination with a polycarboxylate selected from the group consisting of aliphatic dicarboxylic acids having from 2 to 8 carbon atoms, aliphatic tricarboxylic acids, having from 4 to 8 carbon atoms, benzenedicarboxylic acids, benzenetricarboxylic acids and hydrolyzable partial esters thereof with aliphatic alcohols having from 1 to 6 carbon atoms and 1 to 6 hydroxyl groups, as partial replacement of said pickling agents, basic chrome salt tanning agent and tanning auxiliaries.

25. The process of claim 24 wherein said aluminosilicate is employed in an amount of from 10 to 50 gm/l, based on the anhydrous active substance and said polycarboxylate is employed in an amount of from 1 to 20 gm/l.

* * * * *